United States Patent [19]

Förster

[11] Patent Number: 4,758,153

[45] Date of Patent: Jul. 19, 1988

[54] VAPORIZER FOR LIQUID FUEL FOR PRODUCING A FUEL-AIR MIXTURE

[75] Inventor: Siegfried Förster, Alsdorf, Fed. Rep. of Germany

[73] Assignee: Kernforschungsanlage Jülich Gesellschaft mit beschränkter Haftung, Jülich, Fed. Rep. of Germany

[21] Appl. No.: 888,750

[22] Filed: Jul. 22, 1986

[30] Foreign Application Priority Data

Jul. 26, 1985 [DE] Fed. Rep. of Germany ..... 3526866

[51] Int. Cl.[4] ..... F23D 11/44

[52] U.S. Cl. ..... 431/208; 431/210; 431/215

[58] Field of Search ..... 431/208, 209, 210, 215, 431/240; 48/189.2, 189.5; 261/90, 142, 145; 123/549; 165/90 R, 109.1

[56] References Cited

U.S. PATENT DOCUMENTS

| | | | |
|---|---|---|---|
| Re. 31,841 | 3/1985 | Madsen et al. | 431/208 |
| 676,165 | 6/1901 | Wacker | 165/109.1 |
| 1,996,988 | 4/1935 | Badger | 165/109.1 |
| 2,404,646 | 7/1946 | McCollum | 431/210 |
| 2,974,723 | 3/1961 | Blanchard | 431/240 |
| 3,369,598 | 2/1968 | List | 165/104.18 |
| 4,089,314 | 5/1978 | Bernecker | 261/145 |
| 4,373,903 | 2/1983 | Wunning | 431/215 |
| 4,408,984 | 10/1983 | Forster | 431/208 |
| 4,421,475 | 12/1983 | Frick | 431/208 |

*Primary Examiner*—Carroll B. Dority, Jr.
*Attorney, Agent, or Firm*—Scully, Scott, Murphy & Presser

[57] ABSTRACT

A vaporizer for liquid fuel for producing a fuel-air mixture including a vaporization member for the fuel and which is arranged within a flow chamber for combustion air. The surface of the vaporization member which is streamed against by the combustion air is moistened with fuel. The vaporizer incorporates a vaporizing member arranged within a flow chamber for combustion air, wherein the vaporizing member includes a rotatable or circulating filling or charge of balls whose temperature can be adjusted through heat conduction received from the walls of the flow chamber. Thereby, through the revolving or circulation of the ball filling, and the heat transfer to the balls which are currently at the edge of the ball filling in heat-conductive communication with the temperature-regulated walls of the flow chamber, there takes place a rapid and uniform heating of the ball filling. The large vaporization surface which is made available through the ball filling, additionally allows for the formation of relatively thin fuel films, which can be heated while concurrently avoiding excessive temperatures. The revolving or circulating of the balls additionally provides for a constant movement and displacement of the vaporizing member, as a result of which there can be avoided striated or streaky flows which lead to a non-uniform or irregular formation of the fuel-air mixture.

14 Claims, 2 Drawing Sheets

VAPORIZER FOR LIQUID FUEL FOR PRODUCING A FUEL-AIR MIXTURE

BACKGROUND OF THE INVENTION

1. Field of the Invention

The present invention relates to a vaporizer for liquid fuel for producing a fuel-air mixture including a vaporization member for the fuel and which is arranged within a flow chamber for combustion air. The surface of the vaporization member which is streamed against by the combustion air is moistened with fuel.

2. Discussion of the Prior Art

Vaporizers of this type are known in the art. Thus, for example, in U.S. Pat. No. 4,486,362 there is described an arrangement for the formation of a mixture which is constituted of liquid fuel and combustion air, in which the fuel from a surface moistened by fuel vaporizes in preheated combustion air which flows past the surface. However, for example, during the utilization of heating oil as the liquid fuel, deposits are accumulated on the vaporization surface, which adversely influence the long-term operation of the vaporizer. Moreover, with consideration given to the trickle film which is formed on the vaporization member as a result of gravitation, and whose vaporization surface cannot be constructed sufficiently large, the air temperature is set higher than would be desirable in order to avoid the formation of cracking products in the heating oil. In addition thereto, it is difficult to avoid the discharge or carrying out of fuel droplets which are dragged along by the fuel-air mixture, in order to be able to obtain a fuel- air mixture which is only constituted of fuel vapor and combustion air and to thereby achieve a combustion of the fuel-air mixture which is almost devoid of any noxious materials.

SUMMARY OF THE INVENTION

Accordingly, it is an object of the present invention to avoid the above-mentioned disadvantages through the provision of a vaporizer for liquid fuel which, with a large vaporization surface affords, within a small space, the formation of a fuel-air mixture which possesses a homogeneous quality.

The foregoing object is achieved in a vaporizer of the above mentioned type, which incorporate a vaporizing member arranged within a flow chamber for combustion air, wherein the vaporizing member includes a rotatable or circulating filling or change of balls whose temperature can be adjusted through heat conduction received from the walls of the flow chamber. Thereby, through the revolving or circulation of the ball filling, and the heat transfer to the balls which are currently at the edge of the ball filling in heat-conductive communication with the temperature-regulated walls of the flow chamber, there takes place a rapid and uniform heating of the ball filling. The large vaporization surface which is made available through the ball filling, additionally allows for the formation of relatively thin fuel films, which can be heated while concurrently avoiding excessive temperatures. The revolving or circulating of the balls additionally provides for a constant movement and displacement of the vaporizing member, as a result of which there can be avoided striated or streaky flows which lead to a non-uniform or irregular formation of the fuel-air mixture.

Pursuant to a further feature of the invention, a circulating arrangement for the balls of the ball filling is rotatably supported within the flow chamber. The circulating arrangement can be radially directed or even possess vanes which are arranged along helical lines, which change the position of the balls and therefore take care that the balls will alternatingly come into contact with the temperature-regulated walls of the flow chamber, and set themselves to the temperature which is desired for the vaporization of the fuel.

For the moistening of the ball filling with fuel, provision is made to introduce combustion air into the flow chamber, which contains the liquid fuel in a fine dispersion. The combustion air causes the fuel to be introduced into the ball filling. The fuel will, initially, at least partly, strike against the surface of the balls, and then vaporize through heating of the fuel and combustion air in conformance with the hereby rising partial pressure of the fuel contained in the combustion air. The resultingly formed fuel-air mixture combusts in an advantageous manner almost devoid of any noxious materials.

Combustion air and fuel can be conveyed to the vaporizer in an advantageous manner at ambient temperature. The combustion air and the fuel which is carried there along in a fine dispersion thus enters the inlet region of the vaporizer in a cold state. In order that the temperature profile in the vaporizer which adjusts itself in this manner during the operating condition from the commencement of operation, it is already present during the starting phase, the vaporizer possesses a cooling zone in the inlet region for the combustion air. Thus, the walls of the flow chamber are cooled by a cooling medium at the inlet region. For the remainder, the walls of the flow chamber are heated.

The fuel-air mixture which is formed in the flow chamber is conveyed from the flow chamber to a mixture chamber, which can be closed off at its discharge to the combustion chamber. During the starting phase, as well as during the shutting off, the access of combustible fuel-air mixture to the fuel chamber can be completely blocked.

When required, in order to be able to separate out the non-vaporized fuel particles carried along by the fuel-air mixture already prior to entry into the combustion chamber, pursuant to another feature of the invention, a device for deflecting the flow of the fuel-air mixture is arranged in the mixture chamber. Preferably, this device is formed by the closure of the fuel chamber during its opened position.

Provided for the heating of the walls of the flow chamber is an electrical heating unit. This heating unit, above all, serves for the preheating of the flow chamber during the starting phase prior to the entry into the flow chamber of combustion air which is charged with fuel. During operation, the flow chamber can be advantageously heated with a partial flow of the fuel-air mixture, which is withdrawn from the mixture chamber and ignited. The combustion gas is conducted off into the combustion chamber subsequent to a heat exchange with the walls of the flow chamber. As an alternative thereto, the hot exhaust gas can be employed for the heating of the flow chamber. During the combustion of the fuel-air mixture in an engine, the engine exhaust gas can be used for this purpose.

It is expedient to dose the mixture during the introduction of the fuel as a fine dispersion into the combustion air, in effect, still before the entry of the combustion air charged with fuel into the flow chamber. Consequently, pursuant to a feature of the invention, a regulatable mixture dosing arrangement is arranged ahead of the flow chamber. The mixture dosing arrangement consists of mutually-displaceable discs with through-flow openings which, upon displacement of the discs, vary in their through-flow cross-sections for combustion air and the fuel introduced therein as a fine dispersion. The mixture dosing arrangement, as viewed in the flow direction of the combustion air, is located behind an injection nozzle for liquid fuel. The spraying direction of the injection nozzle is directed towards the discs of the mixture dosing arrangement and sprays fuel at an excess amount. For the receiving and conducting off of the excess fuel, a fuel discharge conduit opens in the region of the mixture dosing arrangement. The fuel is reconveyed to the fuel container. For the purpose of the dosing of the mixture, and to be able to rapidly regulate the required fuel-air mixture, the quantity of combustion air which is conducted towards the flow chamber can already be adjusted prior to the addition of fuel.

BRIEF DESCRIPTION OF THE DRAWINGS

Reference may now be had to the following detailed description of an exemplary embodiment of the invention illustrated schematically in the accompanying drawings, in which.

Figure 1:
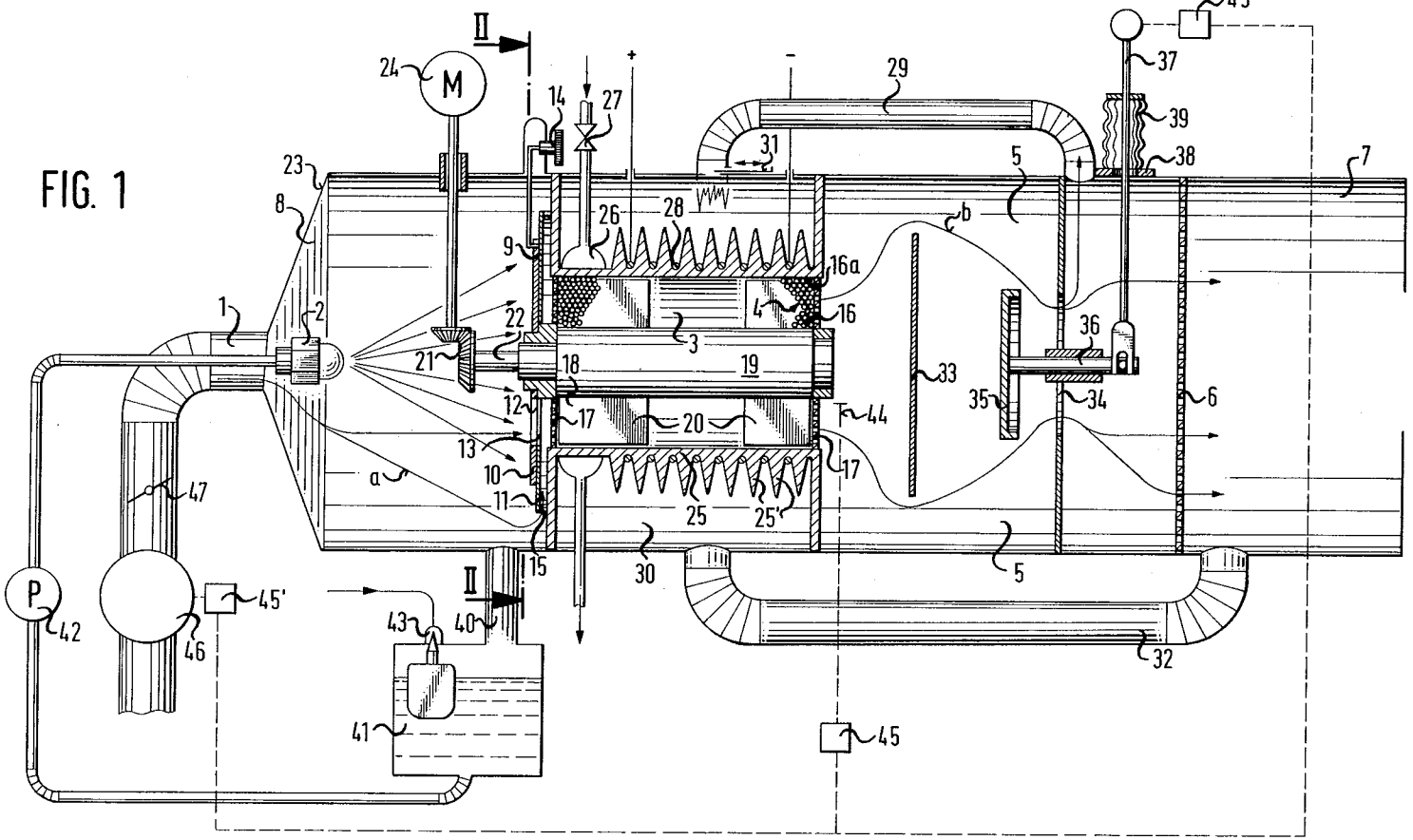
FIG. 1 illustrates a longitudinal section through the inventive vaporizer, taken along section line I—I in FIG. 2.
Figure 2:
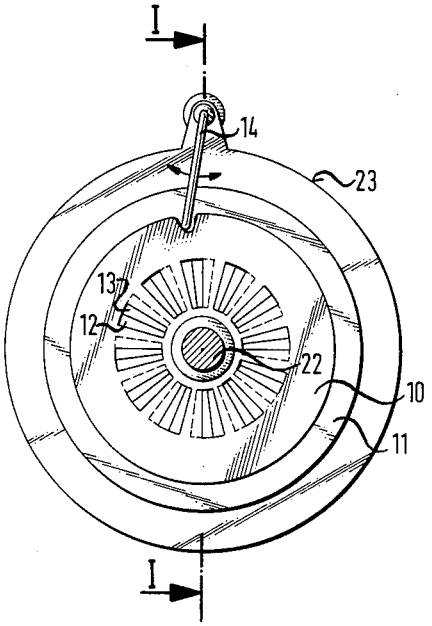
FIG. 2 illustrates a section through the vaporizer taken along section line II—II in FIG. 1.

In the drawing there is illustrated a horizontally arranged vaporizer with a supply conduit 1 for combustion air, an injection nozzle 2 for liquid fuel, a flow chamber 3 containing a ball filling 4, which is traversable by the combustion air, and on which ball filling there forms a film of fuel which vaporizes in the combustion air, as well as a mixture chamber 5 for the fuel-air mixture withdrawing from the flow chamber 3, which finally flows through a flame holder 6 into a combustion chamber 7 and is ignited in the latter. The supply conduit 1 for the combustion air opens into a fuel injection chamber 8 in which a mixture dosing arrangement 9 is located intermediate the injection nozzle 2 and the entry to the flow chamber 3. The mixture dosing arrangement 9 consists of two discs 10, 11 with through-flow openings 12, 13 whose cross-sections can be varied through the intermediary of a setting device 14. Consequently, the quantity of fuel which dragged along by the combustion air as a fine dispersion can also be suitably adjusted even a constant entry of fuel through the injection nozzle 2 to the desired stoichiometric conditions for the combustion of the fuel-air mixture. In the illustrated embodiment, the mixture dosing arrangement 9 possess slits 15 in its edge region, through which the combustion air can stream into the ball filling even with closed through-flow openings 12, 13. The flow paths of the combustion air in the pre-ignition chamber 8 are identified by flow lines a.

The combustion air entering into the fuel-injection chamber 8 charges itself with fuel therein, which is sprayed from the injection nozzle 2, and leads this as a fine dispersion into the flow chamber 3. The cloud or fog of fuel moistens the surface of the balls 16 of the ball filling 4. An extremely thin film of fuel forms itself on the balls. The ball filling 4 is retained within the flow chamber 3 by means of two movable face plates 17, which bound the flow chamber in its inlet region 18 for the fuel and combustion air, as well as towards the mixture chamber 5. The face plates 17 are formed net-like and possess cutouts with opening widths which are smaller dimensioned than are the diameters of the balls 16.

By means of a revolving or circulating device 19 including vanes 20 extending into the ball filling 4, the balls 16 of the ball filling 4 are revolved or circulated within the flow chamber 3. The revolving device 19 which, in the illustrated embodiment, is coaxially arranged and rotatably supported within the cylindrical flow chamber 3, is moved in rotation by means of a drive 21 which is fastened to a shaft end 22 of the revolving device 19 located outside of the flow chamber 4. The revolving device 19 is driven by an electric motor 24 which is arranged outside of the vaporizer housing 23.

In the illustrated embodiment, the vanes 20 of the revolving device 19 are radially oriented and constructed planar. The vanes are arranged offset relative to each other in such a manner that the balls can deviate or escape between the vanes during movement of the revolving device. For this purpose, the axial vane lengths are dimensioned shorter than the expanses of the flow chamber. Instead of radial planar vanes there can also be employed, for example, scoop-like curvilinear vanes which are arranged along helical lines.

The circulating balls 16 come into contact with the walls 25 of the flow chamber during their movement within the flow chamber 3, and are hereby heated to the wall temperature. The walls 25 are heated and are only coolable in the inlet region 18 of the flow chamber through the intermediary of a cooling medium. For this purpose, a cooling medium conduit 26 encompasses the inlet region 18, into which the cooling medium can be introduced after the opening of a shutoff valve 27. The inlet region 18 is cooled in particular during the heating of the walls 25 in the starting phase of the vaporizer. The temperature in the inlet region 18 can then be maintained at ambient temperature, in essence, at a temperature at which the combustion air which is charged with the fuel enters into the flow chamber during operation.

Provided for the heating of the walls 25 of the flow chamber 3 is, on the one hand, an electrical heating unit 28, which preheats the walls 25 to operating temperature prior to the commencement of operation of the vaporizer. For heating during operation, in the exemplary embodiment there is contemplated a combustion of a portion of the fuel-air mixture which is produced in the vaporizer. The fuel-air mixture is drawn off through a bypass 29 from the mixing chamber 5, and ignited in a jacket space 30 encompassing the flow chamber 3, between the walls 25 and the vaporizer housing 23. Arranged in the bypass 29 is a regulator, which in the exemplary embodiment is constructed as a slider 31, for the inflow of the fuel-air mixture into the jacket space 30. The combustion gas which is generated during combustion, and which transfers heat to the walls 25 of the flow chamber which possess ribs 25' for improving the heat transfer, is conducted off through a discharge conduit 32 into the combustion chamber 7.

The temperature of the walls 25 is so adjusted that within the ball filling 4 there is achieved a temperature which is adequate for the complete vaporization of the fuel. Assisting in the uniform heating of the balls 16 within the flow chamber 3 is, particularly the constant change in position of each ball 16 of the ball filling 4, whereby especially the balls **16*a* at the edge of the flow chamber, which contact the walls 25, assist in a convective heat transport into the ball filling 4**.

In the mixing chamber 5, which is connected downstream of the flow chamber 3, there is fastened a plate forming deflecting device 33 for the flow of the mixture. The mixture flow in the mixture chamber 5 is marked by the flow arrows B. The mixture flow exits from the mixture chamber 5 at the closeable outlet 34 of the mixture chamber. The outlet 34 is closeable by means of a closure 35, which is shown in FIG. 1 in its opened position. Serving for the opening and closing of the closure 35 is a lever arm 37 which is hinged to a guide 36, and which is lever arm pivotable about a stationary bearing support 38. The lever arm 37, which is conducted through the vaporizer housing 23, is sealed with respect to the surroundings by means of an elastic bellows 39. The separate deflecting device 33 in the exemplary embodiment, can also be obviated when for the deflecting of the flow of the fuel-air mixture, there is employed the closure 35 of the mixture chamber 5 in its opened position.

In order to be able to provide for the moistening of the surfaces of the balls 76 in the ball filling 4, an adequate amount of fuel in a fine dispersion within the combustion air, the injection nozzle 2 sprays fuel in an excess into the pre-ignition chamber 8. The excess fuel is caught by the mixture dosing arrangement 9, and in the illustrated embodiment, streams from the discs 10, 11 of the mixture dosing arrangment to the bottom of the vaporizer housing 23. At the lowest location of the vaporizing housing 23, in the exemplary embodiment there is connected a fuel discharge 40 which reconveys the excess fuel into a fuel container or tank 41. The fuel is aspirated from the fuel container 41 by means of a fuel pump 42 and then conveyed to the injection nozzle 2. In the exemplary embodiment, the fuel container 41 includes an inlet 43 for fresh fuel which automatically replenishes the fuel in the fuel container 41 in dependence upon the extent of the fuel level.

For a heating oil burner with a capacity of between 2 and 20 KW, there were introduced into the flow chamber 3 approximately 27,000 metallic balls each with a diameter of about 2 millimeter to form a ball filling. The length of the filled flow chamber was 60 millimeter, the outer diameter 70 millimeter, whereby the jacket diameter of the revolving arrangement on which there are fastened the vanes 20 extending into the ball filling, was dimensioned so as not to be smaller than 30 mm. The flow chamber was filled with balls to greatest possible extent, however, so that the balls will not mutually block their capability of movement relative to each other. It has been ascertained as being expedient that the annular cross-section of the ball filing between the jacket of the revolving device 19 which is passed through by the combustion air, rotates at 100 revolutions per minute.

Should there be avoided any unfavorable excess temperatures of the balls, especially in the region of the walls 25 of the flow chamber, then the flow chamber must be constructed of sufficient length. In the illustrated embodiment, the temperature of the heated walls was not higher than about 230° C. for a setting of the temperature of the fuel-air mixture in the mixing chamber to about 190° C. It is necessary to also so correlate the dimensions of the revolving device, especially its jacket diameter, such that a temperature will adjust itself on the surface of the revolving device which is only slightly lower than that on the surface of the heated wall of the flow chamber. In the heated ball filling 4, a temperature adjusts itself, which lies below the temperature of the heated walls 25. The temperature is so measured that the maximum fuel quantity which is introduceable into the ball filling through the mixture dosing arrangement will completely vaporize in the combustion air. Through the continual circulating of the balls 16 there is avoided any coking of the fuel and the formation of agglomeration on the ball surfaces and on the walls 25 of the flow chamber 3.

Through a deflection of the fuel-air mixture in the mixture chamber 5 with the assistance of the deflecting device 33, there are held back any non-vaporized fuel particles which are dragged along by the fuel-air mixture. Investigations have indicated that this component of the non-vaporized fuel particles is less than $1\times10^{-3}$ relative to the entire quantity of vaporized fuel.

At the cold start of the vaporizer, the ball filling 4 is circulated with the outlet 34 of the mixture chamber 5 being closed, and heated, by means of the electrical heating unit 28, through the walls 25. Hereby, through spraying into the partially opened mixture dosing arrangement 9, fuel can already be introduced into the ball filling. After reaching a temperature in the flow chamber 3 which is sufficient for the formation of the desired fuel-air mixture, through the intermediary of a temperature sensor 44 which is arranged in the mixture chamber 5 ahead of the face plate 17 which closes off the flow chamber 3, and which measures a reference temperature relative to the temperature in the flow chamber, is transmitted a signal to a regulator 45 which, by means of control apparatus 45', 45'', sequentially actuates an air blower 46 in the supply conduit 1 for the combustion air and opens the closure 35 of the mixture chamber 5. It has been ascertained as being expedient to cool the inlet region 18 of the flow chamber during the cold starting phase upon heating of the flow chamber in order to be able to already set a temperature therein during the starting phase which conforms with the later operating condition of the vaporizer during inlet of the cold combustion air which is charged with fuel.

During the operation of the vaporizer, the electrical heating unit 28 is switched off and, in the illustrated embodiment, replaced through the combustion of a portion of the fuel-air mixture. However, it is also possible to heat the jacket of the flow chamber with hot exhaust gas which is obtained from the engine exhaust during operation of a combustion engine. In the illustrated embodiment, an ignition of the mixture within the jacket space 30 is possible through an ignition of the mixture in the combustion chamber 7, inasmuch as the flame will flash back into the jacket space 30 from the combustion chamber through the exhaust gas conduit 32.

At the switching off of the vaporizer, there is closed the closure 35 of the mixture chamber 5 whereby, initially, the fuel infeed into the fuel-injection chamber 8 must not be interrupted. In order to cool this about the flow chamber 3, there can additionally be employed a cooling medium for the cooling of the inlet region 18 of the flow chamber.

Through the adjustable mixture dosing arrangement it is possible to operate the vaporizer at different capacities or output levels. Additionally, through the arrangement of a throttle valve 47 in the supply conduit 1 for combustion air it is possible to vary the flow of air. In accordance with the set of flow of air, there is so regulated the flow cross-section through a displacement of the discs of the mixture dosing arrangement, as to maintain a constant-remaining ratio of the quantity of air and the quantity of fuel carried along therewith.

What is claimed is:

1. Vaporizer for liquid fuel for the formation of a fuel-air mixture, including wall means defining a flow chamber, means for supplying combustion air to said flow chamber, means for heating said wall means, a vaporization member arranged within said flow chamber, said vaporization member having the surfaces thereof streamed about by the combustion air and being moistenable with fuel, the improvement in that said vaporization member comprises a circulatable ball filling, wherein the balls of said filling located at the edge of the ball filling are in heat-conductive communication with temperature regulatable walls of the flow chamber, ball moving means rotatably supported in said flow chamber for circulating the balls of said ball filling, and means for conducting liquid fuel in a fine dispersion by the combustion air to the flow chamber for moistening the ball filling with fuel.

2. Vaporizer as claimed in claim 1, wherein the walls of the flow chamber include a cooling means at the inlet region for cooling combustion air entering the flow chamber.

3. Vaporizer as claimed in claim 1, wherein a mixture chamber is connected to the discharge of the flow chamber, and said mixture chamber having a closeable outlet communicating with a combustion chamber and means for closing said outlet.

4. Vaporizer as claimed in claim 3, comprising means in said mixture chamber for deflecting the flow of the fuel-air mixture.

5. Vaporizer as claimed in claim 4, wherein said deflecting means for the flow of the fuel-air mixture is constituted from said means for closing the mixture chamber in the opened position thereof.

6. Vaporizer as claimed in claim 1, wherein said heating means includes an electrical heating means.

7. Vaporizer as claimed in claim 1, further comprising means for heating the flow chamber with hot exhaust gas during operation of said vaporizer.

8. Vaporizer as claimed in claim 1, further comprising mixture dosing means for regulating the mixture dosing of fuel and air, said mixture dosing means disposed in the flow direction of the combustion air and upstream of the flow chamber.

9. Vaporizer as claimed in claim 8, wherein said mixture dosing means comprises mutually displaceable discs having through-flow openings for combustion air and fuel, and wherein the fuel openings have variable flow cross-sections dependent upon the relative settings between the disc.

10. Vaporizer as claimed in claim 8 wherein said mixture dosing means, viewed in direction of flow of the combustion air towards the flow chamber, is located behind an injection nozzle for liquid fuel.

11. Vaporizer as claimed in claim 8, wherein a fuel conduit for receiving and conducting off excess fuel opens in the region of the mixture dosing means.

12. Vaporizer as claimed in claim 1, wherein said ball moving means includes rotating shaft disposed within the flow chamber for turning and moving the balls into and out of contact with said flow chamber walls.

13. Vaporizer as claimed in claim 12 further comprising a plurality of vanes extending into the ball filling for assisting in the movement of the balls.

14. Vaporizer as claimed in claim 13 wherein the vanes are fastened to said rotating shaft.

* * * * *

UNITED STATES PATENT AND TRADEMARK OFFICE

CERTIFICATE OF CORRECTION

PATENT NO. : 4,758,153

DATED : July 19, 1988

INVENTOR(S) : Siegfried Forster

It is certified that error appears in the above-identified patent and that said Letters Patent is hereby corrected as shown below:

Column 1, line 49: "change" should read as --charge--

Signed and Sealed this

Twenty-second Day of August, 1989

*Attest:*

*Attesting Officer*

DONALD J. QUIGG

*Commissioner of Patents and Trademarks*